United States Patent [19]

Gentil

[11] 3,971,417

[45] July 27, 1976

[54] HAND LOOM

[76] Inventor: Henri Gentil, 5, avenue Pierre Semard, Bourg, Ain, France

[22] Filed: Apr. 11, 1975

[21] Appl. No.: 567,100

[30] Foreign Application Priority Data

Apr. 12, 1974 France ..... 74.13621

[52] U.S. Cl. ..... 139/34

[51] Int. Cl.[2] ..... D03D 29/00

[58] Field of Search ..... 139/29–34; 28/15, 2; 66/1 A, 4

[56] References Cited

UNITED STATES PATENTS

| | | | |
|---|---|---|---|
| 639,989 | 12/1899 | Jansen | 139/33.5 |
| 2,096,659 | 10/1937 | Webster et al. | 139/33 |
| 2,166,668 | 7/1939 | Webster et al. | 139/33 |
| 3,347,281 | 10/1967 | Stars | 139/29 |

FOREIGN PATENTS OR APPLICATIONS

| | | | |
|---|---|---|---|
| 54,757 | 5/1938 | Denmark | 139/34 |
| 670,826 | 8/1929 | France | 139/34 |
| 547,795 | 8/1932 | Germany | 139/34 |
| 612,662 | 5/1935 | Germany | 139/34 |
| 457,982 | 3/1928 | Germany | 139/33.5 |

*Primary Examiner*—James Kee Chi
*Attorney, Agent, or Firm*—Karl F. Ross; Herbert Dubno

[57] ABSTRACT

A hand loom has a support formed with a multiplicity of parallel guides. A plurality of elongated parallel needles of a first group are each longitudinally slidably received in a respective guide and are each formed at one end with a hook and at the other end with an eye. A second group of similar elongated parallel needles is interleaved with the first group and these needles are also each received in a respective guide of the support. A first holder releasably grips the needles of the first group and a second holder releasably grips the needles of the second group so that each of these groups can be longitudinally slidably displaced in the holder relative to the other group. The hooks of the one group are advanced beyond the hooks of the other group and a weft filament is laid over the advanced hooks that are then retracted to draw this filament under the needles of the other group. Then the weft filament is laid back over the projecting needles of the other group and so on to form a weft on the needles. A warp filament is then threaded through the eye of each needle and as each needle is withdrawn it pulls the warp filament through the weft.

6 Claims, 14 Drawing Figures

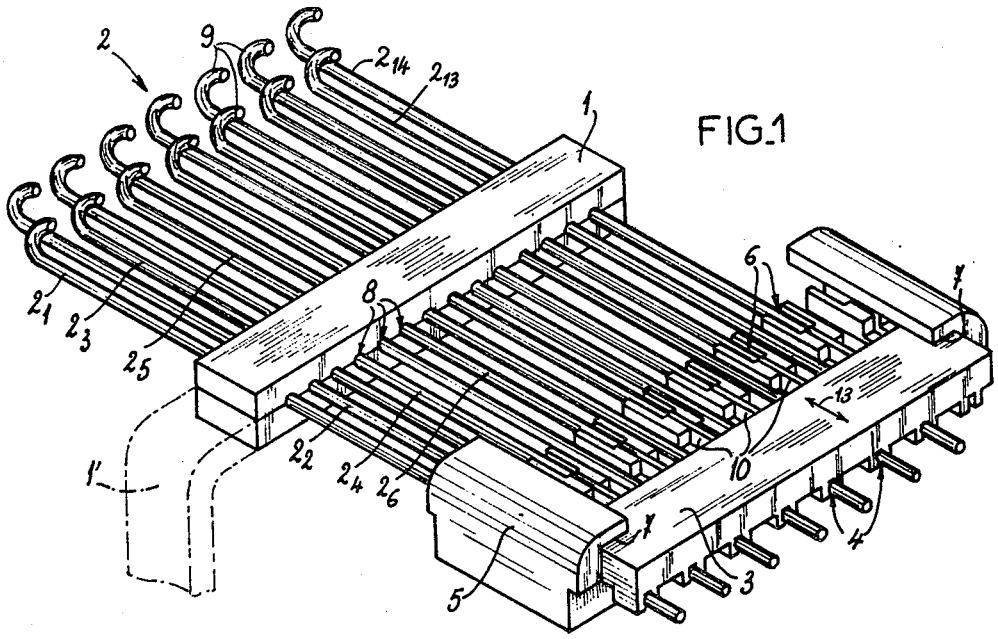
FIG.1
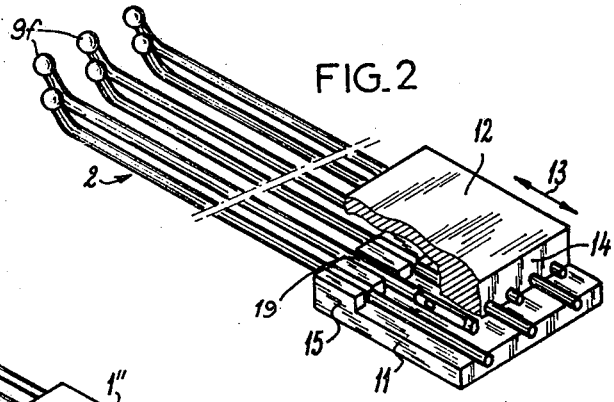
FIG.2
FIG.3
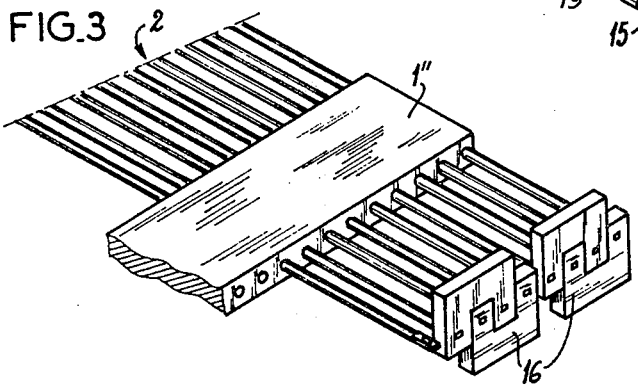

HAND LOOM

FIELD OF THE INVENTION

The present invention relates to a weaving apparatus and, more particularly, to a hand weaving system.

BACKGROUND OF THE INVENTION

Hand looms are known for the at-home or private making of woven goods. The most simple type of hand loom known, however, is relatively complicated and requires that the operator have a thorough understanding of weaving principles in order to produce a usable or attractive product. One of the principal difficulties with these hand looms is setting up the warp, an operation that frequently takes as much time as does the weaving itself.

Another difficulty with such manually operated looms is that they are extremely impractical when it is only desired to produce a small swatch or piece of textile. This is due to the difficulty in setting up the loom so that it is unproductive to weave an item having a small area.

OBJECTS OF THE INVENTION

It is therefore an object of the present invention to provide an improved weaving system.

Another object is to provide a hand loom which can be used even by a relatively unskilled person who is not knowledgeable of weaving principles.

Another object is to provide such a system which can readily be used to weave small pieces of fabric.

Yet another object is the provision of a weaving apparatus which is relatively inexpensive to manufacture.

SUMMARY OF THE INVENTION

These objects are attained according to the present invention in a weaving apparatus comprising a support having a multiplicity of parallel guides in which are longitudinally slidable a first group of elongated parallel needles and a second group of elongated parallel needles interdigitated with the needles of the first group. These needles are all formed at one end with a hook and the other end with an eye. A first holder releasably grips all of the needles of the first group and a second holder independent of the first holder releasably grips the needles of the second group. Thus displacement of either of these holders shifts its group of needles relative to the other group.

According to the present invention it is possible with this apparatus to lay a weft filament across the needles, then advance one of the groups or sets of needles relative to the other and lay the weft thread back across only this advanced group. Then the advanced group is retracted and the other group is advanced so as to form a weft. When a weft of the desired width is obtained each warp needle is pulled out of the weft, drawing behind it a respective warp filament which has been threaded through its eye. Unlike a conventional weaving operation in this system the weft is laid and effectively beaten up by the retraction of the hooks and only after this weft is formed is the warp inserted.

According to other features of this invention more than two such holders can be provided in order to obtain particularly patterned textiles. It is also possible in accordance with this invention to combine the support with one of the holders.

BRIEF DESCRIPTION OF THE DRAWING

The above and other objects, features, and advantages of the invention will become more readily apparent from the following description, reference being made to the accompanying drawing in which:

FIG. 1 is a perspective view of an apparatus according to the present invention, FIGS. 2 and 3 are partly sectional perspective views of other arrangements in accordance with this invention.

SPECIFIC DESCRIPTION

Figure 4:
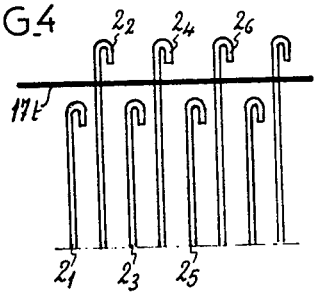
FIGS. 4–7 are diagrammatic plan views illustrating the operation of the device of FIG. 1.

As shown in FIG. 1 an array 2 of needles $\mathbf{2}_{1\text{-}14}$ are longitudinally slidable in a two-part holder 1 formed by a pair of clamped-together bars 1 formed at their interface with parallel cylindrical guide grooves 8 each receiving a respective needle. Each needle is formed at its front end with a simple semicircular hook 9, all of these hooks 9 being parallel to one another and perpendicular to a plane defined by the array 2. At their opposite ends each of the needles $\mathbf{2}_{1\text{-}14}$ is formed with a flattened region 10 having an eye 18 (see FIG. 8) that opens parallel to the plane of the array 2.

Every other or odd-number needle $\mathbf{2}_{1,3,5\ldots13}$ has a flattened region 10 formed inwardly of its extreme back end and received in a rectangular-section notch 4 in a first holder 3 made of stiff but elastic synthetic-resin material. The other even-number needles $\mathbf{2}_{1,4,6\ldots14}$ whose flattened regions 10 lie substantially inwardly of their extreme back ends have these regions 10 releasably gripped in notches 6 formed in another holder 5. This holder 5 is formed with overreaching edge portions 7 that engage over and around the top of the holder 3 so as to permit this holder 3 to slide back and forth in the direction of double headed arrow 13 relative to the holder 5.

This apparatus, as shown in FIGS. 4–7, functions as follows:

The guide 3 is first retracted so as to leave the even-number needles projecting beyond the odd-number needles. Then a weft filament 17*t* is laid between the hooks 9 of these needles so as only to lie on the shafts of the even-number needles (FIG. 4).

Figure 5:
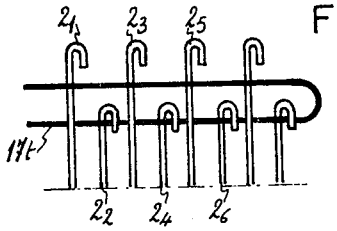

Thereafter these even-number needles are withdrawn (FIG. 5) in back of the hooks of the odd-number needles, with the filament 17*t* automatically being pulled under the odd-number needles, and the filament is doubled back and laid over only the odd-number needles as shown in FIG. 5.

Figure 6:
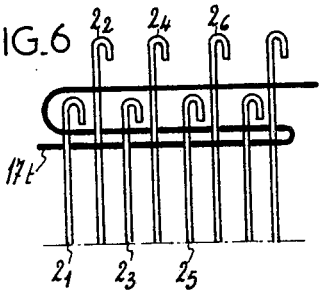

Thereafter as shown in FIG. 6 the even-number needles are again advanced so that their hooks lie forward of the hooks 9 of the odd-number needles, thereby passing over top of the freshly laid section of the weft filament 17*t*. The weft filament is again doubled back and laid over top of the even-number needles as shown in FIG. 6.

Figure 7:
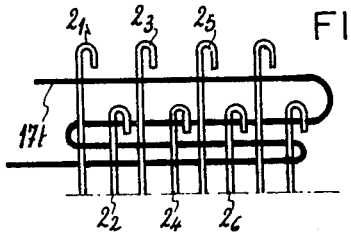

These even-number needles are retracted again as shown in FIG. 7, the filament is doubled back, and these steps repeated until a weft of the desired length is obtained.

Figure 8:
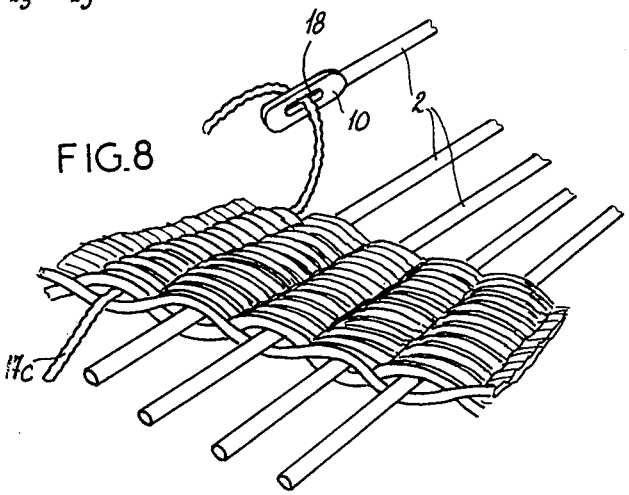
FIG. 8 is a large-scale perspective view illustrating the insertion of a warp filament in accordance with this invention.

Once the weft-laying operation is completed a warp filament 17*c* is passed through each eye 18 of each of the needles and these needles are snapped out of their holders 3 and 5 and pulled by their hooks through the weft (FIG. 8). This operation draws the warp filament 17*t* through the weft and creates a woven piece of textile goods.

Figure 9:
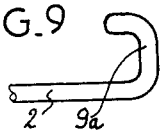
FIGS. 9–14 are side views of different needle ends according to the present invention.
Figure 10:
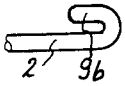
Figure 11:
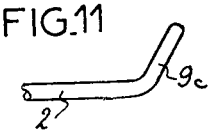
Figure 12:
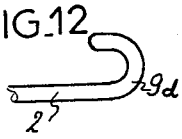
Figure 13:
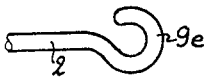
Figure 14:
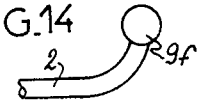

Instead of the semicircular hook 9 as shown in FIG. 1 and FIGS. 4–8, it is possible to provide a generally square hook as is shown at 9*a* in FIG. 9. A very shallow J-shaped hook 9*b* is shown in FIG. 10. Furthermore since half of the time the needles need merely push down the previously laid weft-filament section it is possible to provide needles that have merely an end 9*c* as shown in FIG. 11 that is bent up at an angle of approximately 120° to the shaft of the needle. A J-shaped hook 9*d* having a throat equal to a multiple of the diameter of the needle is shown in FIG. 12 and a button-hook-type end 9*e* is shown in FIG. 13. FIG. 14 has a needle formed generally as shown in FIG. 11 but with a hook 9*f* having a boss or button that projects from the very end of the needle laterally and serves to catch the weft filament.

The arrangement shown in FIG. 2 uses a lower support-holder 11 formed with grippers 15 that each engage one of the flattened regions of one of the odd-number needles and between which are formed channels 19 that act as guides for the even-number needles. Another holder 12 has a rearward section 14 that is formed to grip the even-number needles at their flattened sections and act as a guide for the back ends of the odd-number needles. In this arrangement as well as in the arrangement of FIG. 1 a holder 1′ is provided to clamp this arrangement to a table.

In FIG. 3 the rear ends of the array of needles 2 are fitted into separate holders 16 each of which is press fitted over the flattened rear ends of only two needles separated by another needle. Such an arrangement is particularly useful in the production of intricate patterns or checks. In this arrangement a guide 1′ comprises a simple block of synthetic-resin material formed with a row of parallel coplanar holes.

With the apparatus according to the present invention it is a relatively simple operation for even an unskilled person not at all knowledgeable in the weaving art to produce a hand woven square or swatch of textile goods. The width of the array of needles determines the maximum width of the goods to be produced, but it is possible with this arrangement to produce any length, merely producing separate swatches that are secured together one behind the other by pulling the ends of the protruding warp filaments through the next weft produced. It has been found particularly useful with this device to use relatively elastic wool yarns so as to form woven squares approximately 20 to 25 cm on a side. Such squares are useful in the production of quilts.

I claim:

1. A weaving apparatus comprising:

a support having a multiplicity of parallel guides;

a first group of elongated parallel needles each longitudinally rectilinearly slidably received in a respective guide and each formed at one end with a hook and at the other end with an eye;

a second group of elongated parallel needles interleaved with the needles of said first group and each longitudinally rectilinearly slidably received in a respective guide and each formed at one end with a hook and at the other end with an eye;

a first holder releasably gripping said needles of said first group at their said other end whereby said needles of said first group can be jointly longitudinally rectilinearly displaced by means of said first holder;

a second holder independent of said first holder and releasably gripping said needles of said second group at their said other ends, whereby said needles of said second group can be jointly longitudinally rectilinearly displaced independent of said needles of said first group by means of said second holder and guide means on one of said holders for slidably holding the other said holders and allowing relative sliding therebetween, said needles being all generally coplanar and each of said hooks lies substantially perpendicular to the plane of said needles, each of said holders is formed with a plurality of notches each snugly and elastically receiving a respective needle of a respective group at a flattened region.

2. The apparatus defined in claim 1 wherein each of said needles is formed at its said other end at its eye with said flattened region engageable by the respective holder.

3. The apparatus defined in claim 1 wherein said support and said guide are formed on one of said holders.

4. In a hand-weaving loom of the type wherein a multiplicity of needles are disposed in a parallel array in two groups, the needles of the groups interdigitating with one another, whereby in a first phase a weft web is formed from a yarn and in a second phase the same needles are drawn through the web to insert a warp therein, the needles having a weft-forming hook end and a warp-drawing eye end, the improvement which comprises:

a common fixed support for all of said needles, said needles each being rectilinearly, longitudinally displaceable relative to said support and slidable therein; and a respective movable bar rigid with the needles of each of said group and displaceable relative to said support in the direction of movement of said needles; and wherein the groups of needles are shiftable alternately rectilinearly substantially in a common horizontal plane.

5. The improvement described in claim 4 wherein one of the bars forms at least one slide and the other of said bars is formed as a slide block slidably receiving said slide whereby said slide is displaceable rectilinearly in the interior of said block.

6. The improvement defined in claim 4 wherein the hook end of each of said needles is directed upwardly from said plane whereby a yarn forming the weft is caused to be alternately engaged by the needles of said groups.

* * * * *